United States Patent [19]

A'Costa

[11] Patent Number: 4,515,301

[45] Date of Patent: May 7, 1985

[54] HANDGUN ACCURACY CONTROL HARNESS

[76] Inventor: Anthony A'Costa, 2216 7th Ave., Apt. C 301, Pueblo, Colo. 81003

[21] Appl. No.: 426,341

[22] Filed: Sep. 29, 1982

[51] Int. Cl.[3] ..... F41C 33/00; A45F 5/00

[52] U.S. Cl. ..... 224/204; 224/911; 42/94

[58] Field of Search ..... 42/90, 94; 224/911, 224/913, 150, 204, 259

[56] References Cited

U.S. PATENT DOCUMENTS

| | | | |
|---|---|---|---|
| 995,458 | 6/1911 | Harriman | 224/913 X |
| 1,396,270 | 11/1921 | Grierson | 224/913 X |
| 1,497,794 | 6/1924 | Saunders | 42/94 |
| 2,536,252 | 1/1951 | Bates | 224/913 X |
| 2,985,980 | 5/1961 | Broshous | 42/94 |
| 3,081,923 | 3/1963 | Bagby | 224/913 X |
| 3,221,958 | 12/1965 | Straight | 224/913 X |

*Primary Examiner*—Stephen C. Bentley
*Assistant Examiner*—John S. Maples
*Attorney, Agent, or Firm*—Edwin E. Greigg

[57] ABSTRACT

An accuracy control harness for use with handguns is proposed in which a wide strap arranged to extend across the back of a wearer terminates beneath each of the arms of the wearer. Another strap of greater length is slidably secured to the back strap with one end of this latter strap being adjustably secured to one end thereof in front of the user. The longer strap also includes a terminal portion having a handgun receiving loop.

3 Claims, 5 Drawing Figures

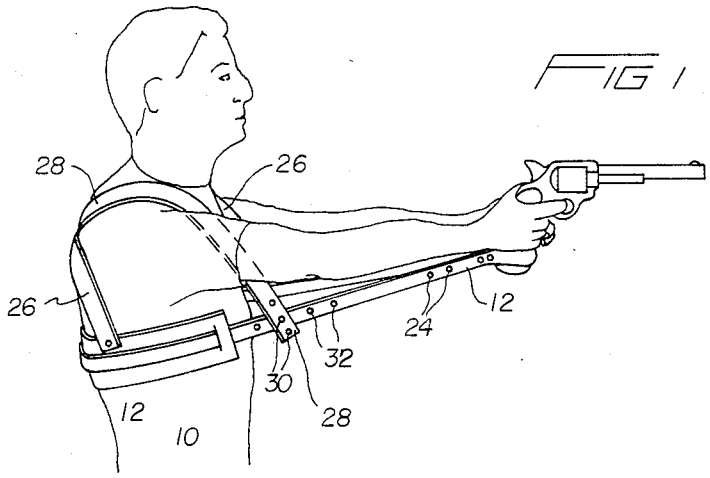
FIG 1
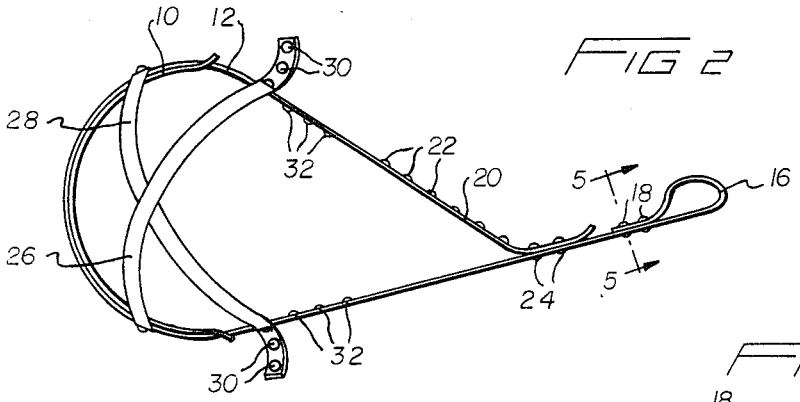
FIG 2
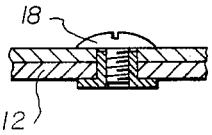
FIG 5
FIG 3
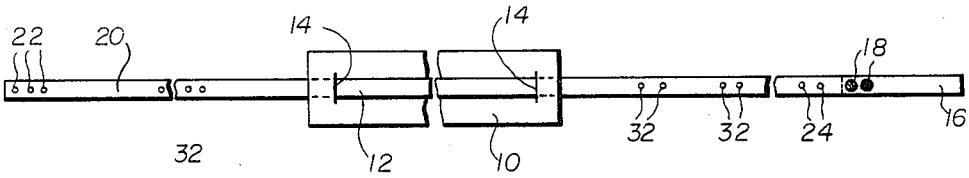
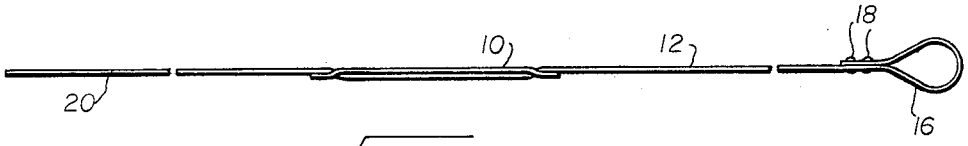
FIG 4

HANDGUN ACCURACY CONTROL HARNESS

This invention relates to devices for holding a handgun steady during shooting and more particularly to a device which is comfortable and will improve ones shooting accuracy.

Handguns are known to be used for many things, some not requiring any means for steadying the gun. There are many gun clubs and persons who shoot at targets in contests or for other reasons. After a prolonged period of shooting a handgun, the handgun seems to become heavier and one becomes shaky which decreases the accuracy of shooting.

It is therefore an object of this invention to provide a harness which can be worn by a person which will steady a handgun during shooting the handgun.

Another object is to provide a harness for handgun shooting which is comfortable and which will improve ones accuracy during shooting a handgun.

Still another object is to provide a harness for handgun shooting which will improve upon safety factors and provide better control of a handgun during shooting.

BRIEF DESCRIPTION OF THE DRAWING

FIG. 1 illustrates a side view of a person wearing an accuracy control harness while holding a handgun.

FIG. 2 illustrates an accuracy control harness for holding a handgun in place.

FIG. 3 illustrates a body portion of the harness without shoulder straps attached.

FIG. 4 is a view from the top looking at the thickness of the body straps without the shoulder straps.

FIG. 5 is a screw-attaching means.

DETAILED DESCRIPTION

Now referring to the drawings there is shown by illustration in FIg. 1 a side view of the person with a handgun accuracy control harness attached to a handgun. The harness includes a short, wide, body, strap 10 which fits along the back of the person. A long narrow strap 12 slides through slits 14 in the wide, body, strap near the ends thereof and extends around the person. One end of the strap is provided with a loop 16 which is formed by folding the end of the strap back along the body of the strap and securing the folded end to the main body by use of screw type rivets 18, snaps, or any other suitable means. The non-looped end 20 of the strap 12 is provided with equally spaced holes 22 along a portion of its length through which threaded rivets can be placed to attach the end 20 to the narrow strap in front of the person by use of spaced holes 24, as shown in FIG. 3. Snaps could be fitted onto the straps instead of holes 22 and 24 so that the snaps could be snapped together. The holes or snaps are added so that the strap can be adjusted for different sized persons.

In order to provide added support for the harness, shoulder straps 26 and 28 are added to prevent the straps 10 and 12 from sliding downward. The strap 26 is secured to the right side of the wide body strap, a distance from its end and is secured to the non-looped end 20 of the strap 12. The shoulder strap 28 is secured to the wide strap a distance from the left end and is secured to the looped-end of the strap inwardly of the loop 16. The ends of the shoulder straps that are secured to the strap 12 are provided with equally spaced snaps 30 so that the shoulder straps can be adjusted for different sized persons by snapping into snap receiver 32. When the harness is worn by a user, the shoulder strap 26 secured to the back strap in from the right end extends up over the left shoulder and is secured to the non-looped end portion of the narrow strap. The shoulder strap that is secured to the left side of the wide back, strap extends over the right shoulder and is secured to the right end portion of the narrow strap 12 inwardly of the loop 16. Snap elements can be equally spaced along the narrow strap ends for adjustment for different sized persons.

The back straps 10, the long strap 12, and the shoulder straps 26 and 28 can be made of any suitable material such as plastic, leather, nylon material, etc, so long as the material is light weight, comfortable and will not stretch.

For the purpose of illustration, the body strap 10 can be 20 inches in length and 3 inches wide; the narrow strap 12 can be 6 feet $1\frac{3}{4}$ inches in length, with a width of $\frac{3}{4}$ inch, with $4\frac{3}{4}$ inches turned back to form the loop 16. The shoulder straps may be $2\frac{1}{2}$ feet in length and are secured to the back strap 12, 6 inches in from the ends and 1 inch down from the upper surface. These dimensions may be changed in order to make a harness for the youth, and for overgrown men.

The narrow strap has been shown in FIGS. 1 and 2 on the outside of the back strap, obviously the narrow strap can be on the inside if preferred. This is easily changed by removing the wide back, strap from the narrow strap and sliding the narrow stap in from the opposite side of the wide, back strap. Further, the narrow strap can be secured to the back strap by use of rivets, snaps or other means than by the slits, as shown.

In use, the harness is fitted onto the body by extending the narrow strap around the chest with the back strap along the back. The non-looped end 20 is snapped or otherwise connected to the looped end inwardly of the end of the loop. The shoulder straps are crossed in the back and secured to the narrow strap in front of the body. The shoulder straps and the end connection 20 of the narrow strap are provided with equally spaced snaps or other connectors for adjustment purposes. The narrow strap is adjusted so that when the arms are extended, the hands grip the handgun with a comfortable grip. The handle of the handgun slips through the loop 16 as shown in FIGS. 1 and 2.

The foregoing relates to a preferred exemplary embodiment of the invention, it being understood that other embodiments and variants thereof are possible within the spirit and scope of the invention, the latter being defined by the appended claims.

What is desired to be secured by Letters Patent of the United States:

1. A handgun accuracy control harness which comprises:

a wide, elongated, back strap, having right and left ends, in which said back strap extends linearly across a user's back, a narrow strap secured to said back strap, and having a much greater length than said back strap, said narrow strap including a loop on one end in which a handle of a handgun is to be placed during firing, and a non-looped end, fastening means secured to said non-looped end of said narrow strap for securing said non-looped end of said narrow strap to said looped end of said strap inwardly of said loop, a first shoulder strap secured at one end to said back strap inwardly of said right end and includes an unsecured end, a second shoulder strap secured at one end to said back strap inwardly of said left end and includes an unsecured end, said first and second shoulder straps including equally spaced fastening means along said unsecured ends said fastening means securing said first and second shoulder straps to said narrow strap inwardly of said non-lopped end and inwardly of said looped end, respectively.

2. A handgun accuracy control harness as claimed in claim 1 in which:

said wide back strap is wider than said narrow strap and includes slits near its left and right end in which said slits parallel said left and right ends, and said narrow strap is secured to said back strap by passing through said slits in said back strap.

3. A handgun accuracy control harness as claimed in claim 1 in which said narrow strap and said first and second shoulder straps include means thereon for adjusting said harness for different sized persons.

* * * * *